US005941461A

United States Patent [19]

Akin et al.

[11] Patent Number: 5,941,461

[45] **Date of Patent: *Aug. 24, 1999**

[54] NOZZLE ASSEMBLY AND METHOD FOR ENHANCING FLUID ENTRAINMENT

[75] Inventors: J. Edward Akin; Stephen K. Smith; N. Roland Dove, all of Houston, Tex.

[73] Assignee: Vortexx Group Incorporated, Houston, Tex.

[ * ] Notice: This patent is subject to a terminal disclaimer.

[21] Appl. No.: 08/939,544

[22] Filed: Sep. 29, 1997

[51] Int. Cl.[6] ..... B05C 5/00

[52] U.S. Cl. ..... 239/428.5; 239/418; 239/DIG. 8

[58] Field of Search ..... 239/418, 423, 239/428.5

[56] References Cited

U.S. PATENT DOCUMENTS

| | | | |
|---|---|---|---|
| 1,388,490 | 8/1921 | Suman . | |
| 1,754,671 | 4/1930 | Dahl . | |
| 1,833,477 | 11/1931 | Tomanek . | |
| 2,365,941 | 12/1944 | Crake | 255/61 |
| 2,657,024 | 10/1953 | Reinecke | 261/76 |
| 2,903,239 | 9/1959 | Standridge | 255/61 |
| 3,358,783 | 12/1967 | Raynal et al. | 175/393 |
| 3,414,070 | 12/1968 | Pekarek | 175/393 |
| 3,528,704 | 9/1970 | Johnson, Jr. | 299/14 |
| 3,548,959 | 12/1970 | Hasiba | 175/393 |
| 3,713,699 | 1/1973 | Johnson, Jr. | 299/14 |
| 3,838,742 | 10/1974 | Juvkam-Wold | 175/393 |
| 4,055,300 | 10/1977 | Binoche | 239/418 X |
| 4,184,806 | 1/1980 | Prinz | 417/160 |
| 4,262,757 | 4/1981 | Johnson, Jr. | 175/67 |
| 4,323,130 | 4/1982 | Dennis | 175/329 |
| 4,378,853 | 4/1983 | Chia et al. | 175/340 |
| 4,391,339 | 7/1983 | Johnson, Jr. | 175/393 |
| 4,436,166 | 3/1984 | Hayatdavoudi et al. | 175/65 |
| 4,512,420 | 4/1985 | Hayatdavoudi et al. | 175/67 |
| 4,515,227 | 5/1985 | Cerkovnik | 175/65 |
| 4,519,423 | 5/1985 | Ho et al. | 137/823 |
| 4,533,005 | 8/1985 | Morris | 175/393 |
| 4,555,059 | 11/1985 | Collins et al. | 239/425 |
| 4,640,374 | 2/1987 | Dennis | 175/393 |
| 4,687,066 | 8/1987 | Evans | 175/340 |
| 4,731,887 | 3/1988 | Henkin et al. | 4/541 |
| 4,768,532 | 9/1988 | Johnson | 134/111 |
| 4,809,381 | 3/1989 | Brandenburger et al. | 15/1.7 |
| 4,957,242 | 9/1990 | Schadow et al. | 239/990 |
| 5,025,875 | 6/1991 | Witt | 175/393 |
| 5,048,445 | 9/1991 | Lever et al. | 114/222 |
| 5,083,386 | 1/1992 | Sloan | 37/57 |
| 5,133,503 | 7/1992 | Giordano et al. | 239/532 |
| 5,295,425 | 3/1994 | Hediger | 83/177 |
| 5,382,003 | 1/1995 | Sankaranarayanan et al. | 266/230 |
| 5,494,124 | 2/1996 | Dove et al. | 175/424 |
| 5,518,395 | 5/1996 | Maughan | 431/8 |
| 5,632,349 | 5/1997 | Dove et al. | 175/393 |
| 5,676,214 | 10/1997 | Pearce et al. | 175/340 |

*Primary Examiner*—Andres Kashnikow
*Assistant Examiner*—Sean P. O'Hanlon
*Attorney, Agent, or Firm*—Browning Bushman

[57] ABSTRACT

A nozzle assembly is disclosed which includes a housing 12 having inlet opening 13 in fluid communication with at least one outlet opening 14 adapted to receive a nozzle body 42. The housing also includes a housing face 16 in surrounding relationship to the outlet opening 14. At least one indentation 18 is formed in the housing. The indentation 18 has a contoured surface 20 defined by first and second side surfaces 22 and 24 in the housing face 16 converging away from the outlet opening 14, and third and fourth side surfaces 26 and 28 in an internal wall 30 of the outlet opening 14 that converge away from the housing face 16. A nozzle body 42 may be releasably disposed within the outlet opening 14. The nozzle body 42 includes a nozzle opening 44 for ejecting a fluid and a nozzle face 46 in surrounding relationship to the nozzle opening 44. At least one indentation 38 is formed in the nozzle face 46 adjacent to, but spaced from, the nozzle opening 44. The contoured surface 20 of the housing 12 is aligned with the contoured surface 52 of the nozzle body 42 to optimize entrainment of a surrounding fluid near each housing and nozzle body indentation 20 and 52 into an ejected fluid passing through the nozzle opening 44.

18 Claims, 3 Drawing Sheets

FIG. 1
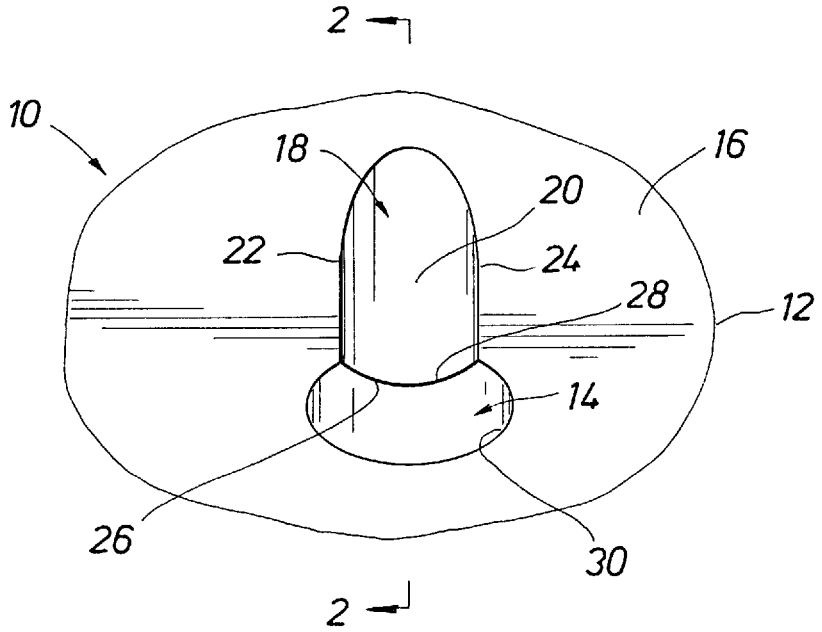
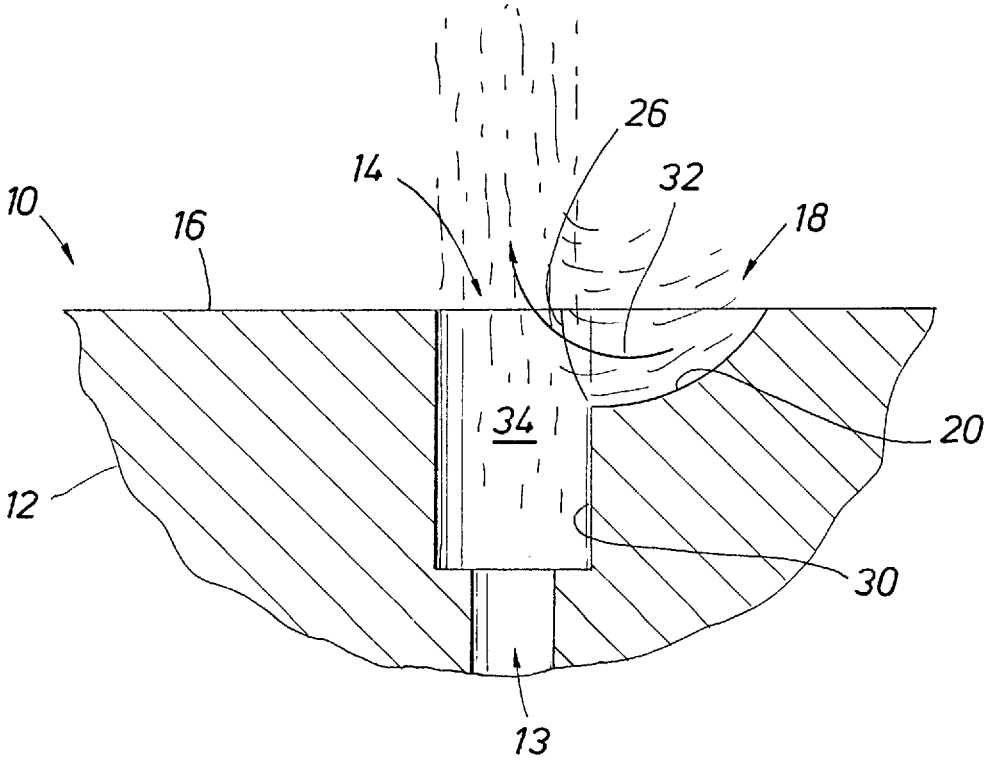
FIG. 2

FIG. 3
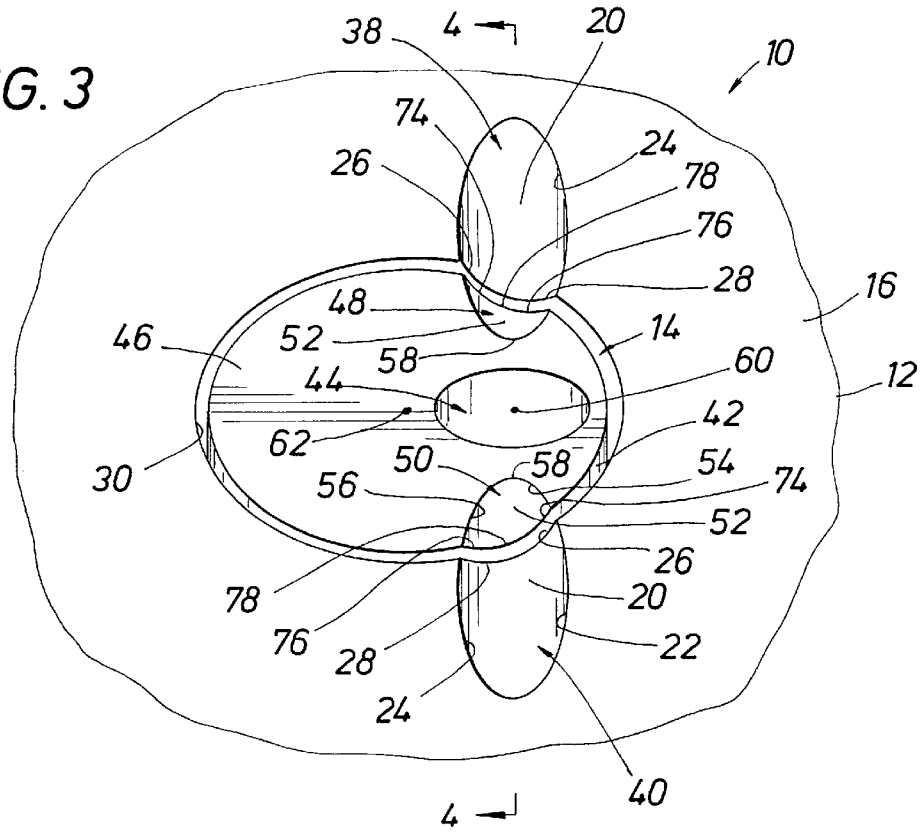
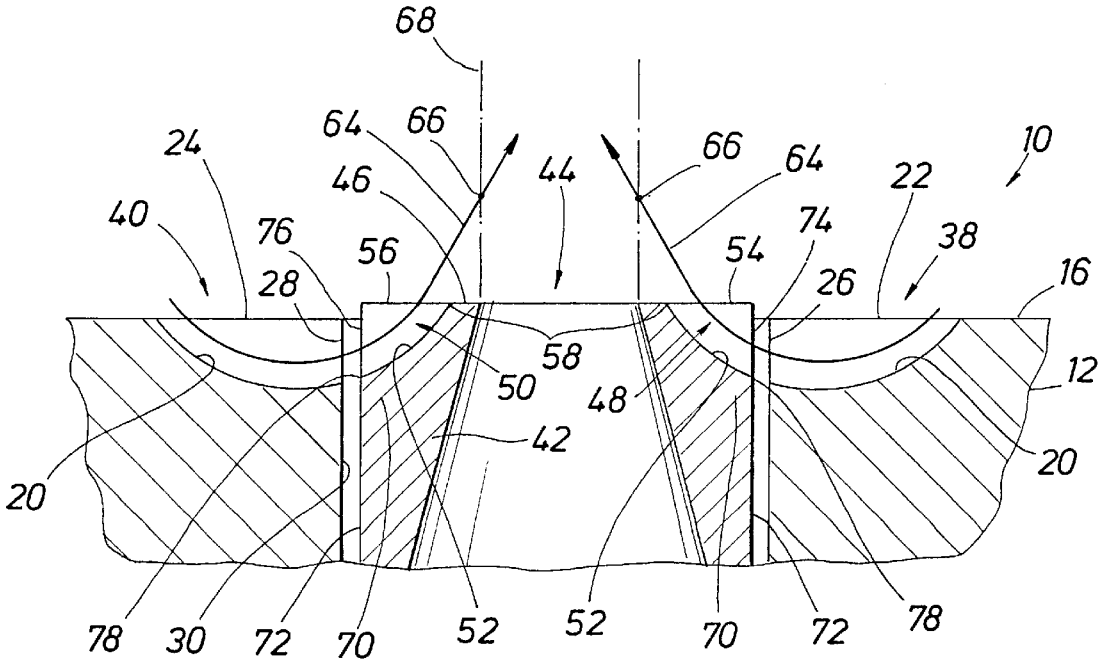
FIG. 4

FIG. 5
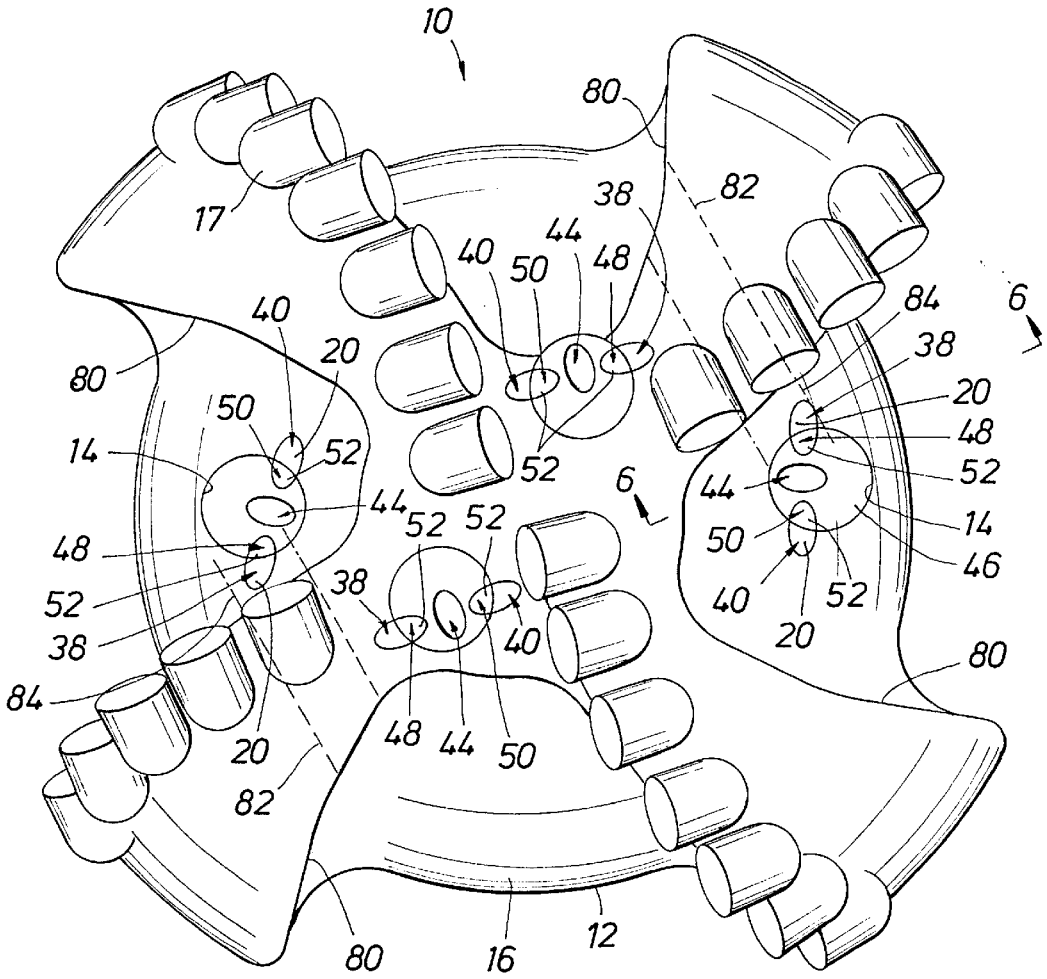
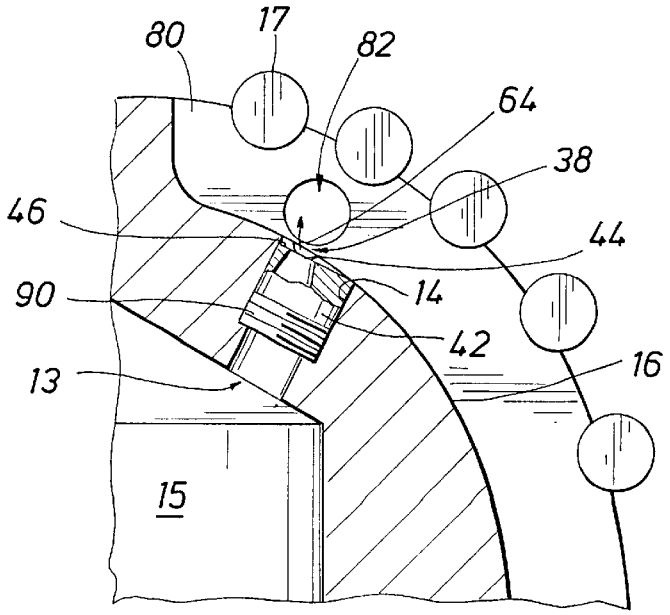
FIG. 6

NOZZLE ASSEMBLY AND METHOD FOR ENHANCING FLUID ENTRAINMENT

FIELD OF THE INVENTION

This invention relates to a multipurpose nozzle assembly and method for enhancing entrainment of a fluid near the nozzle assembly into a desired path of an ejected fluid through the nozzle assembly. In particular, the present invention relates to a nozzle assembly which includes a housing having an inlet opening in fluid communication with one or more outlet openings adapted to receive a nozzle body, whereby the entrainment properties of the nozzle assembly are enhanced by one or more indentations in the housing.

BACKGROUND OF THE INVENTION

Nozzle assemblies are used in a variety of applications, and for several applications the performance of the nozzle assembly is related to the amount of fluid entrained into the fluid being ejected through the nozzle assembly. Typically, nozzle assemblies that attempt to incorporate entrainment properties are utilized in fluid mediums where turbulence exists and entrainment of a fluid surrounding the nozzle into the ejected fluid is desired. Additionally, nozzle assemblies incorporating entrainment properties are utilized in fluid mediums where uniform entrainment of a first fluid surrounding the nozzle into the path of an ejected second fluid is desired.

For purposes of clarity, fluid, as used herein, is intended to encompass any medium which may be emitted through the nozzle opening including, but not limited to, gases, foams, mists, air, steam and the like.

Various nozzle assemblies requiring entrainment and/or mixing of one fluid surrounding the nozzle assembly with another fluid ejected through the nozzle assembly may be included with products such as submersible dredging tools for clearing away material beneath a body of water; underwater cutting apparatus utilizing a jet-like fluid cutting medium; pre-mix combustion devices; hydrotherapy jet assemblies; flow-amplifying liquid atomizing nozzle assemblies; underwater jet assembly cleaning tools for pools, ships and/or offshore drilling rigs; pumping ejectors; fluid mixing devices; and, subterranean drilling tools utilizing nozzles.

In fluid mixing devices where entrainment and mixing properties are required to integrate a first fluid surrounding the nozzle assembly with a second fluid ejected through the nozzle assembly downstream of the nozzle assembly, various shaped nozzle openings and internally contoured nozzle bores or throats have been utilized without regard to the contour of the nozzle assembly's external surface. For example, U.S. Pat. No. 4,519,423 to Ho et al, is an apparatus for mixing fluids that includes a first fluid conductive means terminating in at least one non-circular orifice for emitting a jet of first fluid along a path in a pre-selected direction, and a means for providing a second fluid at a location downstream of the orifice for mixing with the first fluid. In a preferred embodiment, the orifice is elliptical to generate a jet of non-circular cross-section and relatively low aspect ratio. Thus, Ho primarily deals with various jet orifices for emitting a first fluid to enhance mixing with a second fluid downstream from the orifice. And, U.S. Pat. No. 4,957,242 to Schadow et al is also directed to a fluid mixing device in which a jet of first fluid is passed through a nozzle having a conical inlet section and a non-circular elongated exit section. The jet of first fluid mixes with the second fluid located downstream of the device. The interaction of the conical and elongated sections produces axial rotation in the first fluid causing it to mix with the second fluid.

Another application requiring entrainment properties deals with drilling tools where the evacuation of swarth and drilling cuttings is desired. For example, U.S. Pat. No. 3,358,783 to Raynal et al discloses a rotatable drilling tool that includes areas without cutting elements that are generally of a shape which become concave toward the top end and are set back with respect to the cutting areas to allow the evacuation of swarth and drilling cuttings toward the slotted parts on the periphery of the tool.

Additionally, underwater nozzle assemblies for use in hydrotherapy and cleaning applications have revealed a need to entrain the fluid surrounding the nozzle assembly with that being ejected through the nozzle itself. For example, U.S. Pat. No. 4,768,532 to Johnson discloses an underwater pool cleaner that utilizes water pressure to both vacuum and sweep the underwater surfaces of the swimming pool. A venturi restriction is created just forward of the thrust nozzle, creating a low pressure zone that induces flow of water through the bottom of the carriage, generating a vacuum that draws in leaves and other debris. U.S. Pat. No. 5,133,503 to Giordano et al discloses another type of swimming pool cleaning apparatus for cleaning submerged swimming pool surfaces with a direct pressurized and intensified water current. The device includes a nozzle assembly which can concentrate and intensify the water ejected from the assembly so that it can force a water current under the submerged swimming pool in the direction chosen. And, U.S. Pat. No. 4,731,887 to Henkin et al discloses a hydrotherapy jet assembly to discharge a high intensity stream of water into a tub without requiring air entrainment. Water drawn from the tub is entrained by the water jet to maintain the momentum of the water jet in order to produce an apparently high intensity stream for impacting against the user's body, compared to a stream without air entrainment.

Finally, various other applications involve the entrainment of a first fluid (air) surrounding the nozzle assembly's exterior surface into the path of an ejected second fluid in order to either dilute, mix or otherwise integrate the two fluids at a location downstream of the nozzle assembly. For example, U.S. Pat. No. 4,555,059 to Collins et al discloses a liquid atomizing nozzle in which intermixing of air and liquid occurs externally of the nozzle and the primary air utilized for such intermixing is amplified by the entrainment of ambient secondary air. Air under pressure is discharged through radial openings in the cylindrical section of the tubular nozzle body and is redirected by a collar surrounding the cylindrical section to form a high-velocity stream of air about and along the gradually tapered outer surface of the nose section. U.S. Pat. No. 5,518,395 to Maughan relates to fuel nozzles that employ an entrainment feature for initial partial premixing of gaseous fuel and air. Thus, a fuel nozzle assembly is provided comprising a fuel inlet means having a reduced cross-sectional area; a first air inlet means located adjacent to the reduced cross-sectional area; an expansion area having first and second ends such that the first end is located adjacent to the first air inlet means; a fuel and air outlet means located adjacent to the second end of said expansion area; a second air inlet means located adjacent to the fuel and air inlet means a fuel and air mixing means located adjacent to the fuel and air outlet means; and the second air inlet means; and a combustion chamber located adjacent to the swifter means for combusting the fuel and air.

It is therefore, apparent from the above that there exists a need in the art for a nozzle assembly that incorporates a housing adapted to receive a nozzle body, the housing having at least one or more indentations ideally contoured to permit a fluid surrounding each indentation to be entrained into another ejected fluid through the nozzle body in order to direct the integrated fluids therby, increasing the turbulence and velocity of the combined fluids downstream of the nozzle assembly.

SUMMARY OF THE INVENTION

It is a general object of the present invention to provide a nozzle assembly and method for enhancing the entrainment of a fluid near the nozzle assembly into a desired path of a fluid ejected through an opening in the nozzle assembly.

It is therefore, a principal object of the present invention to provide a nozzle assembly that includes a housing having at least one indentation therein, and at least one outlet opening for releasably securing a nozzle therein, whereby entrainment in each indentation is improved by the ejection of another pressurized fluid through an opening in the nozzle.

It is another object of the present invention to provide a nozzle assembly that includes a nozzle body carried by a housing, the nozzle body having at least one indentation aligned with at least one indentation in the housing for improving entrainment of fluid surrounding each indentation by the ejection of a pressurized fluid through an opening in the nozzle body.

It is another object of the present invention to provide a nozzle assembly that will improve the rate and degree of integration of two different fluids such as air and gas by entraining a first fluid near an external surface of the nozzle assembly into a desired path of a second pressurized fluid ejected through an opening in the nozzle assembly.

It is another object of the present invention to provide a nozzle assembly that will increase the rate of drill bit penetration by entraining a fluid near an external surface of the nozzle assembly into a desired path of a pressurized fluid ejected through an opening in the nozzle.

It is another object of the present invention to provide a nozzle assembly that will increase bottom-hole cleaning in the bottom of a borehole by entrainment of fluid near an external surface of the nozzle assembly into the desired path of a pressurized fluid ejected through an opening in the nozzle assembly.

It is still another object of the present invention to provide a nozzle assembly that will intensify the velocity and turbulence of an ejected fluid in hydrotherapy and underwater cleaning devices by entrainment of fluid near an exterior surface of the nozzle assembly into the desired path of the ejected fluid.

It is still another object of the present invention to provide a method for enhancing entrainment of a fluid near an exterior surface of the nozzle assembly into a desired path of a pressurized ejected fluid through an opening in the nozzle assembly.

It is a principal feature of the present invention to provide a nozzle assembly that includes a nozzle body carried by a housing, the nozzle body having at least two indentations aligned with at least two indentations in the housing at primary locations for entrainment of fluid surrounding each indentation by the ejection of a pressurized fluid through an opening in the nozzle body.

It is another feature of the present invention to provide a nozzle assembly that includes a nozzle body carried by a housing, the nozzle body having at least two indentations aligned with at least two indentations in the housing at secondary locations for entrainment of fluid surrounding each indentation by the ejection of a pressurized fluid through an opening in the nozzle body.

It is yet another feature of the present invention to provide a nozzle assembly that includes a nozzle body carried by a housing, the nozzle body having at least one indentation aligned with an internally contoured surface of the nozzle body and an indentation in the housing for improving entrainment of fluid surrounding each indentation by the ejection of a pressurized fluid through an opening in the nozzle body.

The above and various other objects and advantages of the present invention will become apparent from the following summary, detailed description of the preferred embodiments, drawings and claims.

Accordingly, the foregoing objectives are achieved by the nozzle assembly of the present invention which includes a housing having an inlet opening in fluid communication with at least one outlet opening adapted to receive a nozzle body. The housing also includes a housing face in surrounding relationship to the outlet opening. At least one indentation is formed in the housing. The indentation has a contoured surface defined by first and second side surfaces in the housing face converging away from the outlet opening and third and fourth side surfaces in an internal wall of the outlet opening that converge away from the housing face. Preferably, the contoured surface is substantially concave, but may be planar.

In a preferred embodiment, the nozzle assembly includes a nozzle body releasably contained within an outlet opening. The nozzle body includes a nozzle opening for ejecting a fluid and a nozzle face in surrounding relationship to the nozzle opening. At least one indentation is formed in the nozzle face adjacent to, but spaced from, the nozzle opening and includes a contoured surface defined by first and second side surfaces that converge toward the nozzle opening to form a first leading edge closest to the nozzle opening. Preferably, the contoured surface is substantially concave, however, it may be planar. The imaginary extension of at least a portion of the contoured surface converges at a focal point distal the nozzle face, defining an entrainment path. The focal point is closer to an imaginary projection of the nozzle opening extending outwardly from and normal to the nozzle face than the first leading edge is to the nozzle opening. The contoured surface extends through an upper portion of a side wall of the nozzle body and includes third and fourth side surfaces that converge away from the nozzle face to form a second leading edge in the side wall below the nozzle face. The first and second leading edges may be curvilinear, linear, or a single reference point.

The first and second side surfaces of the contoured surface in the housing are aligned with the first and second side surfaces of the contoured surface in the nozzle body, and the third and fourth side surfaces of the contoured surface in the side wall are aligned with the third and fourth side surfaces of the contoured surface in the internal wall. Accordingly, the nozzle body is rotatably mounted within the outlet opening for aligning the contoured surface of the nozzle body with the contoured surface of the housing. The inlet opening communicates with a source of pressurized fluid for transmission of the pressurized fluid through the outlet opening thereby, entraining fluid surrounding each indentation in the housing and nozzle body into the fluid ejected through the nozzle opening.

The contoured surface in the nozzle body and housing may be aligned with a contoured internal surface of the nozzle body for optimal entrainment of the fluid in each housing and nozzle body indentation by the fluid ejected through the nozzle opening.

The imaginary extension of at least a portion of the contoured surface of each indentation may define a primary entrainment path or a secondary entrainment path, contingent upon the positioning of the indentations in the nozzle body relative to the nozzle opening and internally contoured surface of the nozzle body.

Another embodiment of the nozzle assembly includes a nozzle body having a nonconcentrically disposed nozzle opening from a center of the nozzle face and first and second indentations. Each first and second indentation is adjacent to, but spaced from, the nozzle opening and has a contoured surface that is substantially concave and is defined by first and second side surfaces converging toward the nozzle opening to form a first leading edge in the nozzle face closest to the nozzle opening. The imaginary extension of at least a portion of each contoured surface converges at a focal point distal the nozzle face, defining a primary entrainment path. The focal point is positioned closer to an imaginary projection of the nozzle opening extending outwardly from and normal to the nozzle face than the first leading edge is to the nozzle opening. The contoured surface for each first and second indentation extends through an upper portion of a side wall of the nozzle body and includes third and fourth side surfaces that converge away from the nozzle face to form a second leading edge in the side wall below the nozzle face. The first and second leading edges may be curvilinear, linear or a single reference point.

The housing includes a first and second indentation, each indentation having a contoured surface that is substantially concave and is defined by first and second side surfaces in the housing face that converge away from the outlet opening and third and fourth side surfaces in an internal wall of the outlet opening that converge away from the housing face. The first and second side surfaces of the contoured surface for each first and second indentation in the housing are aligned with the first and second side surfaces of the contoured surface for each first and second indentation in the nozzle body, and the third and fourth side surfaces of the contoured surface for each first and second indentation in the side wall are aligned with the third and fourth side surfaces of the contoured surface for each first and second indentation in the internal wall.

Each first and second indentation in the nozzle body and first and second indentation in the housing are therefore positioned on opposite sides of the nozzle opening at primary locations for entrainment. Alternatively, each first and second indentation in the nozzle body and first and second indentation in the housing may be positioned at secondary locations for entrainment by positioning the first leading edge for either first and second indentation in the nozzle body closer to the center of the nozzle face than a center of the nozzle opening and aligning the first and second indentation in the housing with the first and second indentation in the nozzle body.

In another embodiment, the nozzle assembly includes a housing that is a drill bit having an inlet opening in fluid communication with one or more outlet openings, each outlet opening adapted to receive a nozzle body therein. The drill bit housing includes a housing face in surrounding relationship to each outlet opening and at least one indentation in the housing, each indentation having a contoured surface that is substantially concave and is defined by first and second side surfaces in the housing face that converge away from the outlet opening, and third and fourth side surfaces in an internal wall of the outlet opening that converge away from the housing face.

Each nozzle body is releasably contained within each outlet opening and includes a nozzle opening for ejecting a fluid and a nozzle face in surrounding relationship to the nozzle opening. The nozzle body also includes at least one indentation adjacent to, but spaced from, the nozzle opening. Each indentation has a contoured surface that is substantially concave and is defined by first and second side surfaces that converge to form a first leading edge in the nozzle face closest to the nozzle opening. The imaginary extension of at least a portion of each contoured surface converges at a focal point distal the nozzle face. The focal point is closer to an imaginary projection of the nozzle opening extending outwardly from and normal to the nozzle face than the first leading edge is to the nozzle opening. The contoured surface extends through an upper portion of a side wall of the nozzle body and includes third and fourth side surfaces that converge away from the nozzle face to form a second leading edge in the side wall below the nozzle face. The first and second leading edges may be curvilinear, linear or a single reference point.

The first and second side surfaces of the contoured surface in the drill bit housing are aligned with the first and second side surfaces of the contoured surface in the nozzle body and the third and fourth side surfaces of the contoured surface in the side wall are aligned with the third and fourth side surfaces of the contoured surface in the internal wall. The drill bit housing also includes one or more projections extending above the housing face for installing cutter elements. Each projection has a tubular bore therethrough. The imaginary projection of at least a portion of the tubular bore defines an entrainment path through the tubular bore that intersects at least a portion of the imaginary extension of at least a portion of the contoured surface in the nozzle body. Thus, as the ejected fluid passes through the nozzle body and out of the nozzle opening, fluid surrounding the drill bit housing in the tubular bore is entrained into the housing indentation and nozzle body indentation ultimately integrating with the ejected fluid downstream of the drill bit housing.

A preferred method for enhancing entrainment of a fluid surrounding an external surface of the nozzle assembly includes forming a housing having an inlet opening in fluid communication with at least one outlet opening and a housing face in surrounding relationship to the outlet opening. The housing includes at least one indentation that has a contoured surface defined by first and second side surfaces in the housing face that converge away from the outlet opening and third and fourth side surfaces in an internal wall of the outlet opening that converge away from the housing face.

A nozzle body is formed for positioning in the outlet opening and includes a nozzle opening and nozzle face in surrounding relationship to the nozzle opening. At least one indentation is formed in the nozzle body adjacent to the nozzle opening. The indentation has a contoured surface defined by first and second side surfaces that converge to form a first leading edge in the nozzle face closest to the nozzle opening. An imaginary extension of at least a portion of the contoured surface converges at a focal point distal the nozzle face. The focal point is closer to an imaginary projection of the nozzle opening extending outwardly from and normal to the nozzle face than the first leading edge is to the nozzle opening. The contoured surface also extends through an upper portion of a side wall of the nozzle body and includes third and fourth side surfaces that converge away from the nozzle face to form a second leading edge in the side wall below the nozzle face. Again, the first and second leading edge may be curvilinear, linear or a single reference point.

A distal end of the nozzle body opposite the nozzle face is releasably connected to the outlet opening and rotated to align the first and second side surfaces of the contoured surface in the nozzle body with the first and second side surfaces of the contoured surface in the housing and the third and fourth side surfaces of the contoured surface in the side wall with the third and fourth side surfaces of the contoured surface in the internal wall.

The inlet opening is then connected to a source of pressurized fluid and the nozzle assembly is positioned in the surrounding fluid. The pressurized fluid is then ejected through the nozzle opening into the surrounding fluid, whereby the surrounding fluid in each nozzle and housing indentation is entrained into the path of ejected fluid through the nozzle opening.

Thus, the nozzle body is rotatably mounted within the outlet opening for aligning the contoured surface of the nozzle body with the contoured surface of the housing. The aligned contoured surfaces define a desired path of entrainment for the fluid in each housing and nozzle indentation.

In another preferred method, at least one projection extending above the housing face is formed having a tubular bore therethrough. An imaginary projection of at least a portion of the tubular bore defines an entrainment path through the tubular bore that intersects at least a portion of the imaginary extension of at least a portion of the contoured surface in the nozzle body.

Various other applications may utilize a nozzle assembly and method for enhancing fluid entrainment as described hereinabove, such as for use in fuel injection systems or combustion engines; sand/water blasting or cleaning applications, downhole drilling applications; hydrotherapy use; and other mixing applications.

BRIEF DESCRIPTION OF THE DRAWINGS

FIG. 1 is a partial perspective view of one embodiment of the nozzle assembly showing two indentations in a housing positioned at primary locations for entrainment adjacent opposite sides of an outlet opening in the housing.

FIG. 2 is a cross-sectional side view of the nozzle assembly depicted in FIG. 1 taken along lines 2—2.

FIG. 3 is a partial perspective view of another embodiment of the nozzle assembly showing two indentations in the housing positioned at primary locations for entrainment adjacent opposite sides of the outlet opening and aligned with two indentations in a nozzle body positioned at primary locations for entrainment adjacent opposite sides of an opening in the nozzle body.

FIG. 4 is a cross-sectional side view of the nozzle assembly depicted in FIG. 3 taken along lines 4—4.

FIG. 5 is a bottom view of another embodiment of the nozzle assembly showing a drill bit housing and four nozzles releasably connected thereto, each nozzle including a nozzle body having first and second indentations aligned with first and second indentations in the housing, and a tubular bore through opposing cutter face projections, each bore defining an entrainment path.

FIG. 6 is a cross-sectional side view of the nozzle assembly depicted in FIG. 5 taken along lines 6—6.

DETAILED DESCRIPTION OF PREFERRED EMBODIMENTS

With reference now to FIGS. 1 and 2, a nozzle assembly 10 is shown which includes a housing 12 having an inlet opening 13 in fluid communication with at least one outlet opening 14 adapted to receive a nozzle body as more particularly shown in FIGS. 3 and 4.

The housing 12 includes a housing face 16 in surrounding relationship to the outlet opening 14. At least one indentation 18 is formed in the housing 12. The indentation 18 has a contoured surface 20 defined by first and second side surfaces 22 and 24 in the housing face 16 converging away from the outlet opening 14, and third and fourth side surfaces 26 and 28 in an internal wall 30 of the outlet opening 14 that converge away from the housing face 16. Preferably, the contoured surface 20 is substantially concave, but may be planar.

The inlet opening 13 communicates with a source of pressurized fluid (not shown) that passes through the outlet opening 14 as ejected fluid 34, thereby entraining a fluid 32 surrounding the indentation 18 in the housing 12 into the ejected fluid 34.

With reference now to FIGS. 3 and 4, one preferred embodiment of the nozzle assembly 10 includes a housing 12 with first and second indentations 38 and 40, each indentation having a contoured surface 20 that is substantially concave and defined by first and second side surfaces 22 and 24 in the housing face 16 that converge away from the outlet opening 14, and third and fourth side surfaces 26 and 28 in an internal wall 30 of the outlet opening 14 that converge away from the housing face 16.

The nozzle assembly 10 includes a nozzle body 42 releasably carried by the outlet opening 14 of the housing 12. The nozzle body 42 includes a nozzle opening 44 that is generally circular and non-concentrically disposed from a center 62 of the nozzle face 46. The nozzle face 46 is disposed in surrounding relationship to the nozzle opening 44 which is provided for the ejecting fluid (not shown).

The nozzle body 42 also includes first and second indentations 48 and 50, each first and second indentation 48 and 50 is adjacent to, but spaced from, the nozzle opening 44 and has a contoured surface 52 that is substantially concave and defined by first and second side surfaces 54 and 56 that converge toward the nozzle opening 44 to form a first leading edge 58 in the nozzle face 46 closest to the nozzle opening 44. The first leading edge 58 of each first and second indentation 48 and 50 in the nozzle body 42 is positioned closer to a center 60 of the nozzle opening 44 than a center 62 of the nozzle face 46.

The imaginary extension 64 of at least a portion of each contoured surface 52 for each first and second indentation 48 and 50 in the nozzle body 42 defines an entrainment path that converges at a focal point 66 distal the nozzle face 46. The focal point 66 is positioned closer to an imaginary projection 68 of the nozzle opening 44 extending outwardly from and normal to the nozzle face 46 than the first leading edge 58 is to the nozzle opening 44.

The contoured surface 52 for each first and second indentation 48 and 50 extends through an upper portion 70 of a side wall 72 of the nozzle body 42 and includes third and fourth side surfaces 74 and 76 that converge away from the nozzle face 46 to form a second leading edge 78 in the side wall 72 below the nozzle face 46. The first and second leading edges 58 and 78 may be curvilinear, linear or a single reference point.

The first and second side surfaces 22 and 24 of the contoured surface 20 for each first and second indentation 38 and 40 in the housing 12 are aligned with the first and second side surfaces 54 and 56 of the contoured surface 52 for each first and second indentation 48 and 50 in the nozzle body 42.

Likewise, the third and fourth side surfaces 74 and 76 of the contoured surface 52 for each first and second indentation 48 and 50 in the side wall 72 are aligned with the third and fourth side surfaces 26 and 28 of the contoured surface 20 for each first and second indentation 38 and 40 in the internal wall 30 of the outlet opening 14. Accordingly, the nozzle body 42 is rotatably mounted within the outlet opening 14 for aligning the contoured surface 52 of the nozzle body 42 with the contoured surface 20 of the housing 12. Additionally, the contoured surfaces in the nozzle body 52 and housing 20 may be aligned with a contoured internal surface (not shown) of the nozzle body 42 for optimal entrainment of the fluid (not shown) surrounding each housing indentation 38 and 40, and nozzle body indentation 48 and 50 into the ejected fluid(not shown).

The imaginary extension 64 of at least a portion of the contoured surface 52 of each first and second indentation 48 and 50 in the nozzle body 42 may define a primary entrainment path or a secondary entrainment path, contingent upon the positioning of the indentations in the nozzle body 42 relative to the nozzle opening 44 and internally contoured surface of the nozzle body (not shown). Each first and second indentation 48 and 50 in the nozzle body 42 and first and second indentation 38 and 40 in the housing 12 are therefore, positioned on opposite sides of the nozzle opening 44 at primary locations for entrainment as shown in FIGS. 3 and 4. As the ejected fluid (not shown) passes through the nozzle opening 44, fluid (not shown) surrounding each housing indentation 38 and 40 and each nozzle body indentation 48 and 50 is entrained into the ejected fluid along the primary entrainment paths thus integrating the ejected fluid with the surrounding fluid and increasing the turbulence and velocity of the combined fluids downstream of the nozzle assembly.

Alternatively, each first and second indentation 48 and 50 in the nozzle body 42 and first and second indentation 38 and 40 in the housing 12 may be positioned at secondary locations for entrainment (not shown) by positioning the first leading edge 58 for either first and second indentation 48 and 50 in the nozzle body 42 closer to the center 62 of the nozzle face 46 than the center 60 of the nozzle opening 44 and aligning the first and second indentation 38 and 40 in the housing 12 with the first and second indentation 48 and 50 in the nozzle body 42.

With reference now to FIGS. 5 and 6, another embodiment of the nozzle assembly 10 includes a housing 12 that is a drill bit having an inlet opening 13 in fluid communication with an outlet opening 14, each outlet opening 14 is adapted to receive a nozzle body 42. The drill bit housing 12 includes a housing face 16 in surrounding relationship to each outlet opening 14 and first and second indentations 38 and 40 in the housing 12. Each first and second indentation 38 and 40 in the housing 12 has a contoured surface 20 that is substantially concave.

A distal end 90 of each nozzle body 42 opposite a nozzle face 46 is releasably contained within each outlet opening 14 and includes a nozzle opening 44 for ejecting a fluid (not shown) and a nozzle face 46 in surrounding relationship to the nozzle opening 44. The nozzle body 42 also includes first and second indentation 48 and 50 adjacent to, but spaced from, the nozzle opening 44. Each indentation has a contoured surface 52 that is substantially concave, but may be planar. The imaginary extension 64 of at least a portion of each contoured surface 52 defines an entrainment path that intersects an imaginary projection 68 of the nozzle opening 44 at a focal point 66 as shown better in FIG. 4. Thus, when the contoured surface 20 of the first and second indentations 38 and 40 in the housing 12 are aligned with the contoured surface 52 of the first and second indentations 48 and 50 of the nozzle body 42, a primary entrainment path is defined by the imaginary extension 64 of the aligned contoured surfaces in the housing 12 and nozzle body 42. A drilling fluid (not shown) emitted from the pressurized source 15 is transmitted through the inlet opening 13 into the nozzle body 42 and passes through the nozzle opening 44 as an ejected fluid (not shown). Thus, drilling fluid surrounding the external surface of the nozzle assembly and each first and second indentation 38 and 40 in the housing 12 and each first and second indentation 48 and 50 in the nozzle body 42 is entrained into the ejected fluid distal the nozzle opening 44 along a primary entrainment path 64.

Additionally, the drill bit housing 12 includes a plurality of projections 80 extending above the housing face 16 for retaining cutter elements 17. Each projection 80 may include a tubular bore therethrough 82. The imaginary projection 84 of at least a portion of the tubular bore 82 defines an entrainment path that intersects at least a portion of the imaginary extension 64 of at least a portion of the contoured surface 52 in the nozzle body 42. Therefore, as the ejected fluid (not shown) passes through the nozzle body 42 and out of the nozzle opening 44, the surrounding fluid (not shown) in the tubular bore 82 is entrained into each first and second indentation 38 and 40 in the housing 12 and each first and second indentation 48 and 50 in the nozzle body 42, ultimately integrating with the ejected fluid downstream of the drill bit housing 12.

A preferred method for enhancing entrainment of a fluid surrounding an external surface of the nozzle assembly 10 includes forming a housing 12 having an inlet opening 13 in fluid communication with at least one outlet opening 14 and a housing face 16 in surrounding relationship to each outlet opening 14 as generally seen in FIGS. 3 and 4. The housing 12 includes first and second indentations 38 and 40 that have a contoured surface 20 defined by first and second side surfaces 22 and 24 in the housing face 16 that converge away from the outlet opening 14, and third and fourth side surfaces 26 and 28 in an internal wall 30 of the outlet opening 14 that converge away from the housing face 16.

The nozzle body 42 is formed for positioning in the outlet opening 14 and includes a nozzle opening 44 and nozzle face 46 in surrounding relationship to the nozzle opening 44. First and second indentations 48 and 50 are formed in the nozzle body 42 adjacent the nozzle opening 44. Each first and second indentation 48 and 50 in the nozzle body 42 has a contoured surface 52 defined by first and second side surfaces 54 and 56 that converge to form a first leading edge 58 in the nozzle face 46 closest to the nozzle opening 44. An imaginary extension 64 of at least a portion of the contoured surface 52 converges at a focal point 66 distal the nozzle face 46. The focal point 66 is closer to an imaginary projection 68 of the nozzle opening 44 extending outwardly from and normal to the nozzle face 46, than the first leading edge 58 is to the nozzle opening 44. The contoured surface 52 also extends through an upper portion 70 of a side wall 72 of the nozzle body 42 and includes third and fourth side surfaces 74 and 76 that converge away from the nozzle face 46 to form a second leading edge 78 in the side wall 72 below the nozzle face 46. The first and second leading edges 58 and 78 may be curvilinear, linear or a single reference point.

A distal end 90 of the nozzle body 42 opposite the nozzle face 46 is releasably connected to the outlet opening 14 and rotated to align the contoured surfaces 52 in the nozzle body 42 with the contoured surfaces 20 in the housing 12 as seen in FIGS. 5 and 6.

The inlet opening 13 is then connected to a source of pressurized fluid 15 and the nozzle assembly 10 is positioned in a surrounding fluid. The pressurized fluid (not shown) then passes through the nozzle opening 44 as an ejected fluid (not shown) whereby the surrounding fluid in each nozzle and housing indentation is entrained into the path of the ejected fluid through the nozzle opening 44.

In the event the housing 12 includes a number of projections extending above the housing face 16 as seen in the drill bit embodiment in FIGS. 5 and 6, a tubular bore 82 may be formed in each projection 80. An imaginary projection 84 of at least a portion of the tubular bore 82 therefore defines an entrainment path that intersects at least a portion of the imaginary extension 64 of at least a portion of the contoured surface 52 in the nozzle body 42.

Various other modifications, applications and uses of the nozzle assembly disclosed herein should be apparent from the above description of preferred embodiments. Although the invention has thus been described in detail for these embodiments, it should be understood that this explanation is for illustration only, and that the invention is not limited to these embodiments. Alternate components and installation techniques will be apparent to those skilled in the art in view of this disclosure. Additional modifications are thus contemplated and may be made without departing from the spirit of the invention, which is defined by the claims.

What is claimed is:

1. A nozzle assembly comprising:

a housing having an inlet opening in fluid communication with at least one outlet opening, said outlet opening adapted to receive a nozzle body;

a housing face in surrounding relationship to said outlet opening; and, at least one indentation in the housing, the indentation having a substantially contoured surface defined by first and second side surfaces in the housing face converging away from said outlet opening and third and fourth side surfaces in an internal wall of the outlet opening that converge away from said housing face, whereby a fluid in said indentation may be entrained into another fluid ejected through said outlet opening.

2. The nozzle assembly as defined in claim 1, further comprising:

a nozzle body releasably carried by said outlet opening, and including a nozzle opening for said ejected fluid;

a nozzle face in surrounding relationship to the nozzle opening;

at least one indentation in the nozzle body adjacent to said nozzle opening, the indentation having a substantially contoured surface defined by first and second side surfaces converging to form a first leading edge in the nozzle face closer to said nozzle opening than any other edge of said first and second side surfaces in said nozzle body, an imaginary extension of at least a portion of said contoured nozzle surface defining an entrainment path distal the nozzle face, said entrainment path intersecting an imaginary projection of the nozzle opening extending outwardly from and normal to the nozzle face; and, said contoured nozzle surface extending through an upper portion of a side wall of the nozzle body and including third and fourth side surface that converge away from said nozzle face to form a second leading edge in the side wall below the nozzle face.

3. The nozzle assembly as defined in claim 2, wherein said first and second side surfaces of said contoured surface in said housing are aligned with said first and second side surfaces of said contoured surface in said nozzle body, and said third and fourth side surfaces of said contoured surface in said side wall are aligned with said third and fourth side surfaces of said contoured surface in said internal wall.

4. The nozzle assembly as defined in claim 2, wherein said nozzle body is mounted within the outlet opening such that the contoured surface of the nozzle body is aligned with the contoured surface of the housing, said aligned contoured surfaces defining a desired path of entrainment for the fluid in each housing indentation and nozzle indentation.

5. The nozzle assembly as defined in claim 2, wherein said nozzle opening is generally circular and non-concentrically disposed from a center of the nozzle face.

6. The nozzle assembly as defined in claim 5, further comprising:

first and second indentations in the housing, each indentation having a substantially concave surface defined by first and second side surfaces in the housing face converging away from said outlet opening and third and fourth side surfaces in an internal wall of the outlet opening that converge away from said housing face;

first and second indentations in the nozzle body, each indentation having a substantially concave surface defined by first and second side surfaces converging to form a first leading edge in the nozzle face closer to said nozzle opening than any other edge of said first and second side surfaces in said nozzle body, said first leading edge of each first and second indentation in said nozzle body being positioned closer to a center of said nozzle opening than a center of said nozzle face, an imaginary extension of at least a portion of each concave surface for each first and second indentation in the nozzle body defining a primary entrainment path distal the nozzle face, said primary entrainment path intersecting an imaginary projection of the nozzle opening extending outwardly from and normal to the nozzle face; and said concave nozzle surfaces extending through an upper portion of a side wall of the nozzle body and including third and fourth side surfaces that converge away from said nozzle face to form a second leading edge in the side wall below the nozzle face.

7. The nozzle assembly as defined in claim 1, wherein said inlet opening communicates with a source of pressurized fluid for ejecting said pressurized fluid through said outlet opening.

8. The nozzle assembly as defined in claim 2 further comprising:

at least one projection extending above said housing face, said projection having a tubular bore therethrough, the imaginary projection of at least a portion of said tubular bore defining an entrainment path that intersects at least a portion of the imaginary extension of at least a portion of the contoured surface in said nozzle body.

9. A nozzle assembly comprising:

a housing having an inlet opening in fluid communication with at least one outlet opening;

a housing face in surrounding relationship to said outlet opening;

at least one indentation in the housing, the indentation having a contoured surface defined by first and second side surfaces in the housing face converging away from said outlet opening and third and fourth side surfaces in an internal wall of the outlet opening that converge away from said housing face;

a nozzle body releasably carried by said outlet opening, said nozzle body including a nozzle opening for ejecting a fluid;

a nozzle face in surrounding relationship to the nozzle opening;

at least one indentation in the nozzle body adjacent to said nozzle opening, the indentation having a contoured surface defined by first and second side surfaces converging to form a first leading edge in the nozzle face closer to said nozzle opening than any other edge of said first and second side surfaces in said nozzle body, an imaginary extension of at least a portion of said contoured nozzle surface defining an entrainment path distal the nozzle face, said entrainment path intersecting an imaginary projection of the nozzle opening extending outwardly from and normal to the nozzle face; and, said contoured nozzle surface extending through an upper portion of a side wall of the nozzle body and including third and fourth side surfaces that converge away from said nozzle face to form a second leading edge in the side wall below the nozzle face, whereby a fluid in said housing and nozzle body indentation is entrained into said ejecting fluid.

10. The nozzle assembly as defined in claim 9, wherein said first and second side surfaces of said contoured surface in said nozzle body are aligned with said first and second side surfaces of said contoured surface in said housing and said third and fourth side surfaces of said contoured surface in said side wall are aligned with said third and fourth side surfaces of said contoured surface in said internal wall.

11. The nozzle assembly as defined in claim 9, wherein the nozzle body is mounted within the outlet opening such that the contoured surface of the nozzle body is aligned with the contoured surface of the housing, said aligned contoured surfaces defining a desired path of entrainment for the fluid in each housing indentation and nozzle indentation.

12. The nozzle assembly as defined in claim 9, wherein said nozzle opening is generally circular and non-concentrically disposed from a center of the nozzle face.

13. The nozzle assembly as defined in claim 12, further comprising:

first and second indentations in the housing, each indentation having a substantially concave surface defined by first and second side surfaces in the housing face converging away from said outlet opening and third and fourth side surfaces in an internal wall of the outlet opening that converge away from said housing face;

first and second indentations in the nozzle body, each indentation having a substantially concave surface defined by first and second side surfaces converging to form a first leading edge in the nozzle face closer to said nozzle opening than nay other edge of said first and second side surface in said nozzle body, said first leading edge of each first and second indentation in said nozzle body being positioned closer to a center of said nozzle opening than a center of said nozzle face, an imaginary extension of at least a portion of each concave surface for each first and second indentation in the nozzle body defining a primary entrainment path distal the nozzle face, said primary entrainment path intersecting an imaginary projection of the nozzle opening extending outwardly from and normal to the nozzle face; and said concave nozzle surfaces extending through an upper portion of a side wall of the nozzle body and including third and fourth side surfaces that converge away from said nozzle face to form a second leading edge in the side wall below the nozzle face.

14. The nozzle assembly as defined in claim 9, wherein said housing inlet opening communicates with a source of pressurized fluid for ejecting said pressurized fluid through said nozzle opening.

15. The nozzle assembly as defined in claim 9, further comprising:

at least one projection extending above said housing face, said projection having a tubular bore therethrough, an imaginary projection of at least a portion of said tubular bore defining an entrainment path that intersects at least a portion of the imaginary extension of at least a portion of the contoured surface in said nozzle body.

16. A method for enhanced entrainment of a fluid surrounding an external surface of a nozzle assembly comprising:

forming a housing having an inlet opening in fluid communication with at least one outlet opening, said housing including a housing face in surrounding relationship to said outlet opening;

forming at least one indentation in the housing, the indentation having a contoured surface defined by first and second side surfaces in the housing face converging away from said outlet opening and third and fourth side surfaces in an internal wall of the outlet opening that converge away from said housing face;

forming a nozzle body having a nozzle opening, said nozzle body including a nozzle face in surrounding relationship to the nozzle opening;

forming at least one indentation in the nozzle body adjacent to said nozzle opening, the indentation having a contoured surface defined by first and second side surfaces converging to form a first leading edge in the nozzle face closer to said nozzle opening than any other edge of said first and second side surfaces in said nozzle body, an imaginary extension of at least a portion of said contoured nozzle surface defining an entrainment path distal the nozzle face, said entrainment path intersecting an imaginary projection of the nozzle opening extending outwardly from and normal to the nozzle face, said contoured nozzle surface extending through an upper portion of a side wall of the nozzle body and including third and fourth side surfaces that converge away from said nozzle face to form a second leading edge in the side wall below the nozzle face;

releasably connecting a distal end of the nozzle body opposite the nozzle face to said outlet opening;

aligning said first and second side surfaces of said contoured surface in said nozzle body with said first an second side surfaces of said contoured surface in said housing and aligning said third and fourth side surfaces of said contoured surface in said side wall with said third and fourth side surfaces of said contoured surface in said internal wall;

connecting said inlet opening to a source of pressurized fluid;

positioning the nozzle assembly in said surrounding fluid; and ejecting said pressurized fluid through the nozzle opening into said surrounding fluid, whereby the surrounding fluid in each nozzle and housing indentation is entrained into the pressurized fluid ejected through the nozzle opening.

17. The method as defined in claim 16, wherein said nozzle body is mounted within said outlet opening such that the contoured surface of the nozzle body is aligned with the contoured surface of the housing, said aligned contoured surfaces defining a desired entrainment path for the fluid in each housing indentation and nozzle indentation.

18. The method as defined in claim 16, further comprising:

forming at least one projection extending above the housing face, said projection having a tubular bore therethrough, an imaginary projection of at least a portion of said tubular bore defining an entrainment path that intersects at least a portion of the imaginary extension of at least a portion of the contoured surface in said nozzle body.

* * * * *